United States Patent [19]

Haynes

[11] 4,233,956

[45] Nov. 18, 1980

[54] FIREPLACE SYSTEM

[76] Inventor: Freddie J. Haynes, Rte. 1, Earlsboro, Okla. 74840

[21] Appl. No.: 909,290

[22] Filed: May 24, 1978

[51] Int. Cl.[3] ..... F24B 7/00

[52] U.S. Cl. ..... 126/121; 126/131; 126/143; 126/288

[58] Field of Search ..... 126/120, 121, 131, 143, 126/288, 290

[56] References Cited

U.S. PATENT DOCUMENTS

| | | | |
|---|---|---|---|
| 2,707,464 | 5/1955 | Gillen | 126/121 |
| 4,010,728 | 3/1977 | Hempel et al. | 126/120 |
| 4,013,059 | 3/1977 | Andrews | 126/120 |
| 4,042,160 | 8/1977 | Ickes | 126/121 |
| 4,056,091 | 11/1977 | Moncrieff-Yeates | 126/121 |
| 4,074,679 | 2/1978 | Vensen | 126/121 |
| 4,089,320 | 5/1978 | Brown et al. | 126/121 |
| 4,108,144 | 8/1978 | Wilhaite | 126/120 |

*Primary Examiner*—Carroll B. Dority, Jr.
*Assistant Examiner*—Lee E. Barrett
*Attorney, Agent, or Firm*—William R. Laney

[57] ABSTRACT

A fireplace system comprising a hollow base pan and a shroud supported on the base pan and defining a combustion air chamber of inverted U-shaped configuration having open lower ends communicating with the interior of said hollow base pan. The shroud includes holes which open from the combustion air chamber into a central, front fireplace opening. An air plenum chamber is supported on the base pan adjacent the shroud and includes a firewall which defines a firebox, and a spaced wall which defines with the firewall and with the stack extending upwardly from the firebox, an air plenum space. A damper is located at an elevated location in the stack and includes an operator projecting downwardly to an accessible location at the top and forward side of the firebox. An insulation zone surrounds the air plenum chamber. A pair of firebox doors are movably mounted on the base pan, and a pair of door receiving channels are mounted on opposite sides of the air plenum chamber outside the insulation zone for receiving the doors in a storage status when they are not in use.

16 Claims, 6 Drawing Figures

FIREPLACE SYSTEM

BACKGROUND OF THE INVENTION

1. Field of the Invention

This invention relates to a fireplace system, and more particularly, to a fireplace system adapted for heating air circulating within an edifice in which the system is installed by moving the air adjacent a firebox and vertical stack to receive heat therefrom, and then circulating it to the rooms of the edifice.

2. Brief Description of the Prior Art

A great many proposals have been recently advanced for providing fireplace assemblies and structures which permit a substantial portion of the heat which has previously been discharged to the atmosphere through the stack or chimney to be recovered in air circulating within the edifice in which the fireplace is located, and by this means, to use a portion of the otherwise lost heat from burning wood in the fireplace to heat the edifice. In general, many of these proposals have contemplated the circulation of air from the room in which the fireplace is located in an air plenum space which is adjacent the firebox and, in some instances, a portion of the stack extending upwardly from the firebox, then forcing this warmed or heated air into the central air conditioning and heating ducting normally located within the edifice and by this means conveying it to the rooms to be heated.

Various proposals have been advanced for obtaining a more efficient heat exchange between the burning logs within the firebox and the air as thus circulated. As examples of a number of these proposals which have previously been patented, U.S. Pat. Nos. 3,999,535 to Hall; 4,015,581 to Martenson; 4,026,264 to Henriques; and, 2,791,213 to Goulding may be cited.

BRIEF DESCRIPTION OF THE PRESENT INVENTION

The present invention comprises a quickly and easily assembled fireplace system in which certain modular subassemblies or units of the system are prefabricated and then quickly assembled to provide an efficient fireplace system which rapidly heats air circulated through the system for subsequent passage of the heated air to rooms in the edifice where the fireplace is located.

Broadly described, the fireplace system of the invention comprises a hollow base pan into which combustion air is introduced from any suitable source. A shroud is supported on the base pan and defines a combustion air chamber of inverted, U-shaped configuration having open lower ends which communicate with the interior of the hollow base pan. This shroud includes holes which open from the combustion air chamber into a central, front fireplace opening. An air plenum chamber is supported on the base pan adjacent the shroud, and includes a firewall which defines an open firebox, a second wall spaced from the firewall and defining therewith and with a stack extending upwardly from the firebox, an air plenum space. A damper is located at an elevated location in the stack over the firebox, and includes an operator which projects downwardly through the stack to an accessible location at the top and forward side of the firebox. An insulation zone surrounds the air plenum chamber. A pair of firebox doors are movably mounted on the base pan and a pair of door-receiving channels, are optionally mounted on opposite sides of the air plenum chamber outside the insulation zone for receiving the doors in a storage status when they are not in use but are included as a portion of the fireplace system.

An important advantage of the present invention is to provide structure for more efficiently introducing combustion air to the fireplace.

Another object of the present invention is to provide a fireplace system consisting of several modular units which can be prefabricated and assembled in the fireplace system within substantially any dwelling in which it may be desired to use the system.

A further object of the invention is to provide an improved fireplace system which efficiently and quickly heats air drawn into and through an air plenum zone or chamber within the system from the room in which the fireplace system is located, preparatory to directing the thus heated air to the rooms of an edifice in which the fireplace system is located.

Another object of the invention is to provide an improved dampering assembly in a fireplace system used for heating air in an air plenum chamber surrounding a firebox and stack of the fireplace system.

Another object of the invention is to provide a fireplace system having an aesthetic arrangement for mounting a pair of cooperating fireplace doors within the system in a way such that the doors can be stored in an out-of-the-way, out-of-sight position when it is not desired to use them.

A further object of the invention is to provide a fireplace system which conductively exchanges heat between the firebox within which wood is burned, and air in a surrounding air plenum chamber, all in such a way that the fireplace system is relatively safe by reason of the external walls of the system being maintained relatively cool by an air cooling, thermally insulating blanket which is utilized for effecting such cooling.

Additional objects and advantages will become apparent as the following detailed description of the invention is read in conjunction with the accompanying drawings which illustrate the invention.

GENERAL DESCRIPTION OF THE DRAWINGS

FIG. 5 is a side elevational view of a modified embodiment of the fireplace system.

FIG. 6 is a detail view illustrating an alternate form of damper subassembly which can be used in the fireplace system of the invention.

DETAILED DESCRIPTION OF A PREFERRED EMBODIMENT OF THE INVENTION

Figure 1:
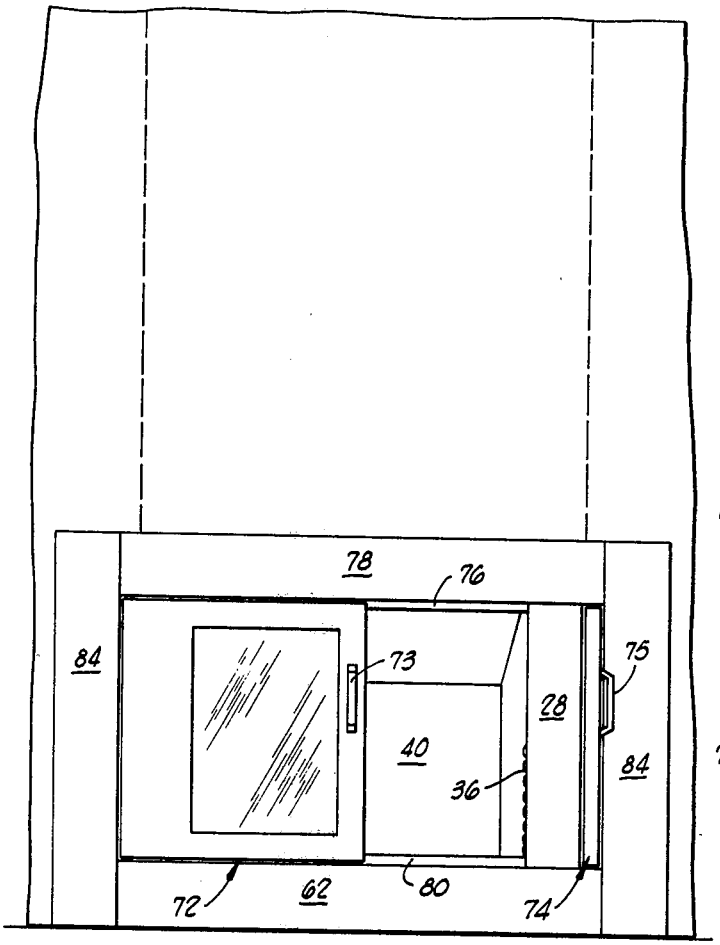
FIG. 1 is a front elevational view of the fireplace system of the invention as it appears when mounted in an interior wall of an edifice in which the fireplace system is located, with a portion of said wall broken away at the outer lateral extremes of the fireplace system.

The fireplace system of the invention includes a hollow base pan designated generally by reference numeral 10. The base pan 10 is of substantially right parallelepiped configuration, and includes a forward wall 12, a pair of side walls 14 and 16, and a back wall 18. The base pan also includes a top wall 20 and a bottom wall 22 which extend substantially parallel to each other and interconnect the side walls 14 and 16 to complete the enclosure of the base pan.

A duct 23 is connected to an opening into the hollow interior of the base pan 10 for introducing combustion air from outside of an edifice in which the fireplace system is mounted, or from another suitable source of combustion air, to be utilized for sustaining combustion in the fireplace system in a manner hereinafter described.

Mounted at the forward side of the fireplace system is a shroud 24. The shroud defines a combustion air chamber having an inverted U-shaped configuration. The shroud 24 has a pair of substantially identical, vertically extending, hollow or tubular legs 26 and 28 at opposite sides thereof, with such legs projecting downwardly through openings formed in the base pan 10 at opposite sides of the base pan. The leg 26 to the left side of the combustion air chamber is illustrated in vertical cross-section in FIG. 3, and includes side walls 30 and 32. Each leg of the U-shaped combustion air chamber 24 has, in the inner side wall thereof corresponding to the wall 32 of the leg 26, a plurality of combustion air openings 34 which open at rearwardly facing, air directing louvers 36 (see FIGS. 3 and 4). The hollow legs 26 and 28 are interconnected by a hollow, horizontally and transversely extending web member 38.

An air plenum chamber and housing is positioned rearwardly from the shroud 24 which defines the inverted U-shaped combustion air chamber. Such air plenum chamber includes a firewall 40 which is bent along a horizontal line at a location spaced above its lower edge, so that a portion of the firewall extends forwardly in the fireplace and defines a smoke shelf designated generally by reference numeral 42. The firewall 40 further includes forwardly extending wings **40*a* and 40*b*** which enclose a firebox.

The air plenum chamber is further defined by a back wall 44 (see FIGS. 2 and 4), a pair of side walls 46 and 48 and a pair of front or forward walls 50 and 52. It will be noted that the forward walls 50 and 52 abut the rear walls of the two legs 26 and 28 of the combustion air chamber defined within the shroud 24. The air plenum chamber encloses between its several walls, an air plenum space 56.

It will be noted from the description thus far that the firewall 40, **40*a* and 40*b*, with its associated smoke shelf 42 defines a firebox designated generally by reference numeral 60, which firebox opens at the front of the fireplace system at an opening which is defined within the shroud 24 between the legs 26 and 28 and web 38** of the combustion air chamber.

Figure 3:
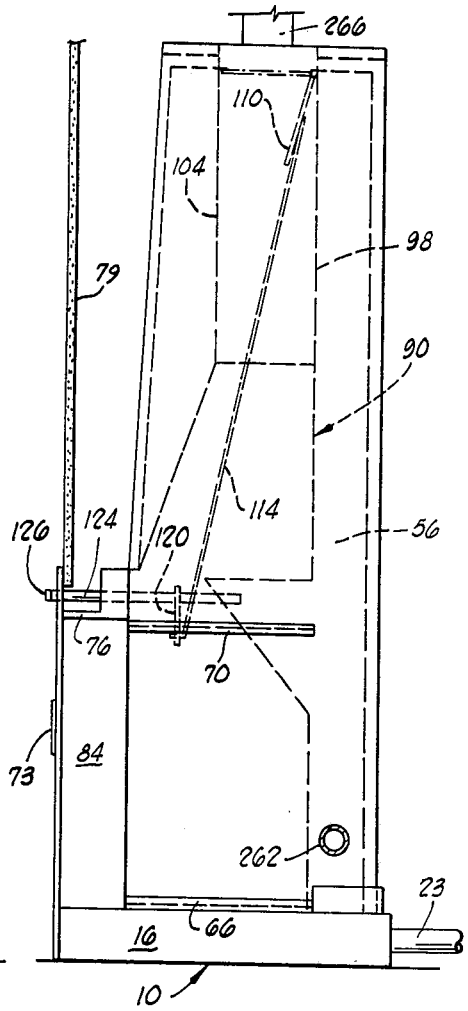
FIG. 3 is a sectional view taken along line 3—3 of FIG. 2.
Figure 2:
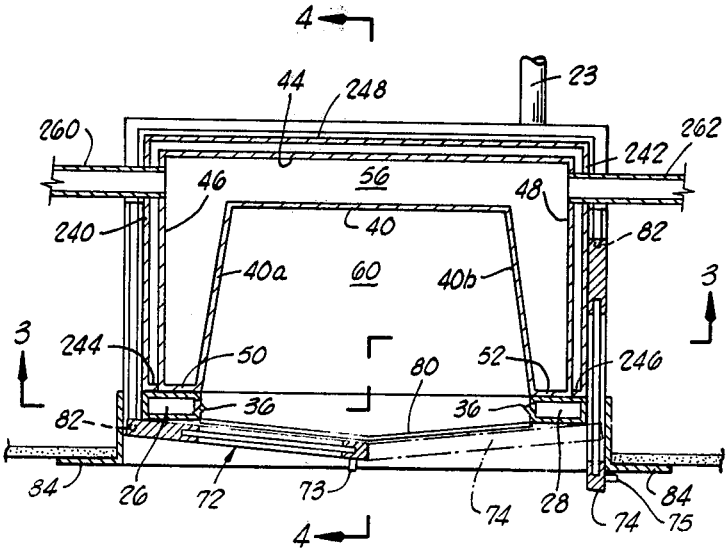
FIG. 2 is a transverse sectional view, taken in a horizontal plane, as indicated by line 2—2 in FIG. 1.
Figure 8:
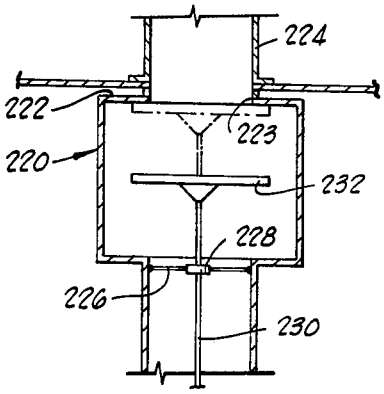
Figure 3:
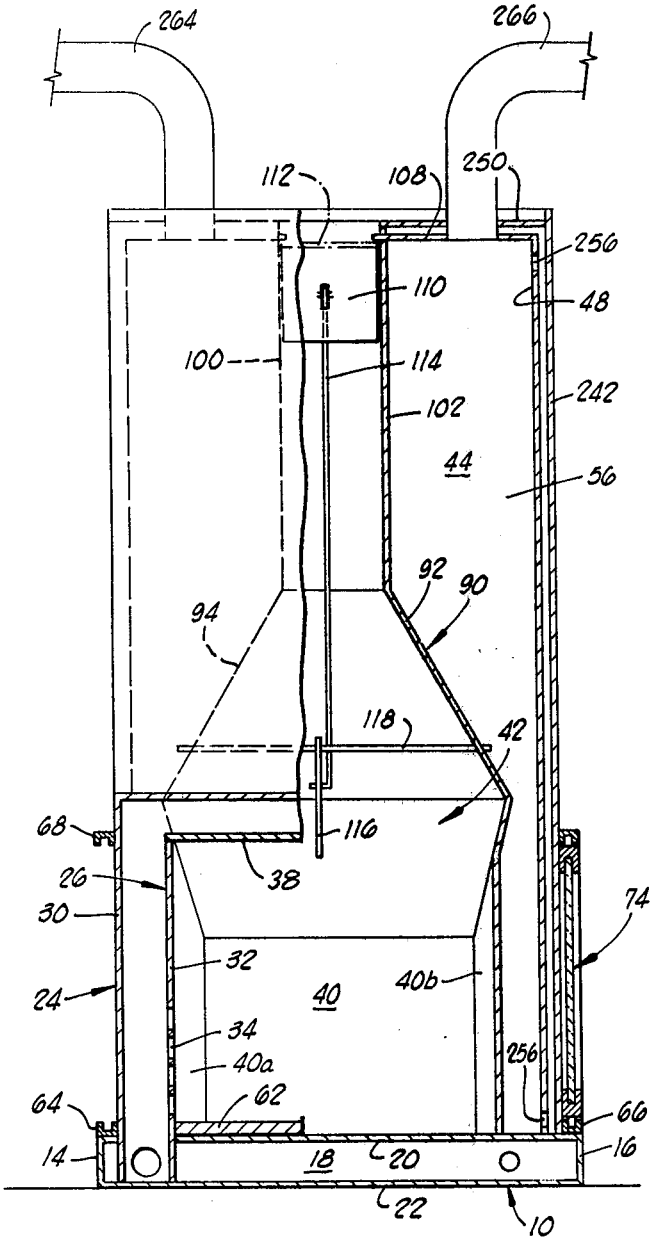
Figure 4:
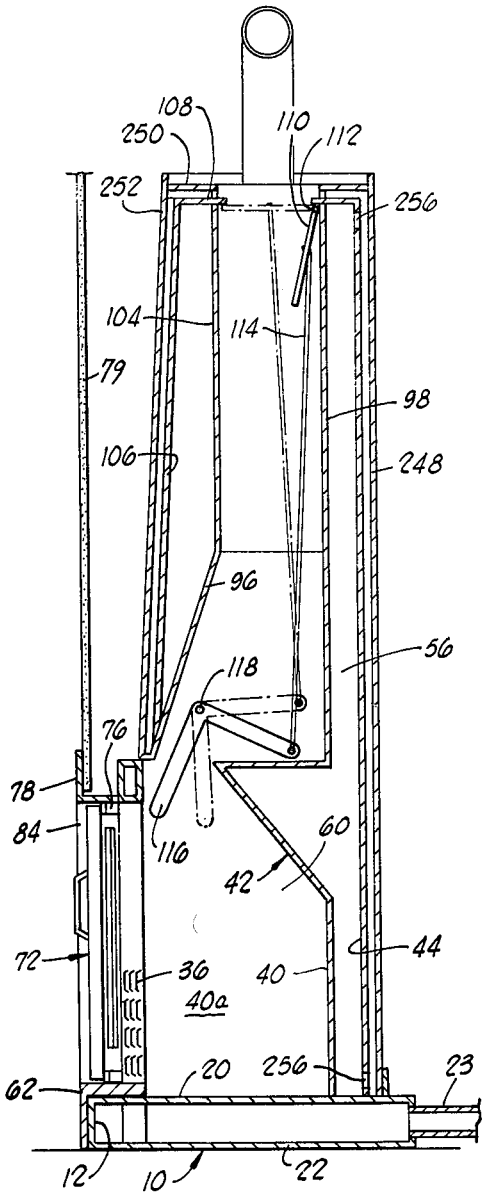
FIG. 4 is a sectional view taken along line 4—4 of FIG. 2.

The hollow base pan 10 projects forwardly beyond the point where it supports the legs 26 and 28 of the shroud 24 so as to provide an outwardly facing ledge or shelf which supports an angled hearth plate 62 as shown in FIG. 4. The base pan 10 also projects laterally or transversely beyond the location where the legs 26 and 28 of the inverted U-shaped combustion air chamber of the shroud 24 extend into the base pan, so as to provide an upwardly facing surface upon which are supported a pair of substantially parallel door receiving lower tracks 64 and 66 (see FIG. 3). Each of the tracks 64 and 66 is of upwardly opening, U-shaped cross-sectional configuration. A pair of downwardly opening, U-shaped cross-sectioned door receiving upper tracks 68 and 70 are supported within the fireplace system at a location directly above, and extending substantially parallel to, the tracks 64 and 66. The manner in which the door receiving tracks are mounted within the system will be subsequently explained in greater detail. The upper and lower pairs of door receiving tracks 64, 66, 68 and 70 are for the purpose of receiving in a stored or out-of-use position, a pair of substantially rectangularly shaped, glass paneled door elements designated generally by reference numerals 72 and 74. In FIGS. 1 and 2 of the drawings, the door element 72 at the left side of the fireplace system is shown in its operative position where it closes a part of the opening across the front of the firebox 60. The door element 72 is provided with a handle 73. The other door element 74 is shown in its stored position, and carries a handle 75.

In order to aid in positioning and guiding the doors as they are moved into their operative, closed position, a V-shaped guide flange 76 extends along the upper side of the opening into the firebox 60 and is secured to the lower side of a lintel angle plate 78 having a U-shaped cross-section as shown in FIG. 5. A panel 79 of sheetrock or other finishing material rests upon and extends upwardly from the lintel plate 78. A similar V-shaped guide flange 80 is secured on the upwardly facing side of the hearth plate 62, and is aligned in vertical alignment with the V-shaped guide flange 76. These guide flanges 76 and 80 together function to position the door elements 72 and 74 in a V-shaped array in the manner shown in FIG. 2, where the position of the stored door 74 when it is instead in its operative position, is also illustrated in dashed lines.

Each of the door elements 72 and 74 carries at its outer upper and lower corners, a pair of retention pins 82 which function to engage and ride in the respective upper and lower door tracks 64–70 to guide the doors as they are swung out and pushed back alongside the air plenum chamber for purposes of storage in the manner shown as characteristic of the right door in FIGS. 1 and 2. It should be pointed out that the outer ends of each of the door tracks 64–68 (that is, the end closest to the front side of the fireplace system) is closed, so that each retention pin 82 at the outer corner of each of the door elements 72 and 74 cannot slip out of the respective door track in which it rides. The door tracks are easily and quickly attachable to, and detachable from, adjacent outer wall elements, hereinafter described, so that the inclusion of doors for closing the opening at the forward side of the firebox becomes optional. Storage of the doors in the illustrated position is also assisted by a pair of angle shaped finishing flanges 84 which are extended between the lintel angle plate 78 and the outer side of the hollow base pan 10.

As earlier noted therein, the air plenum chamber is, in part, defined by, and extends around, a vertically extending stack which is positioned above the firewall 40 at the location immediately over the smoke shelf 42. The stack is best illustrated in FIGS. 3 and 4, and is there designated generally by reference numeral 90. The stack includes a frusto-pyramidal lower section immediately over the smoke shelf 42, which frusto-pyramidal lower section includes a pair of convergent side walls 92 and 94, and a rearwardly and upwardly sloping front or forward wall 96, and a vertically extending back wall 98. The stack 90 further includes a rectangularly cross-sectioned, vertically extending upper portion which includes, in addition to the back wall 98, a pair of substantially parallel side walls 100 and 102, and a vertically extending front wall 104 which extends parallel to the back wall 98. At its upper end, the upper portion of the stack is adapted to communicate with a flue which projects through the roof of the edifice in which the fireplace assembly is located.

It will be noted in referring to FIGS. 3 and 4 that a wall 106 projects upwardly from a point of intersection with the upwardly and rearwardly sloping forward wall of the frusto-pyramidal lower section of the stack 90, and, at its upper end, is joined to the horizontally extending plate 108 which projects across the upper edges of the walls 98, 100, 102 and 104 of the upper portion of the stack 90, and into the interior of the stack to form a ledge or downwardly facing shoulder which completely surrounds the interior of the upper portion of the stack. The plate 108 is also supported on the back wall 44 of the air plenum chamber and the side walls 46 and 48 thereof.

The ledge defined internally of the upper portion of the stack 90 by the top plate 108 functions as an abutment against which a damper plate 110 closes at a time during the hereinafter described operation of the fireplace system. The damper plate 110 is secured to a pivot rod 112 extending along one transverse edge thereof, as shown in FIG. 3, and is substantially rectangular in configuration. Actuating shaft 114 is pivotally connected to the center of the damper plate 110, and projects downwardly within the stack 90 to a point where it is connected to a bell crank arm 116 as shown in the embodiment of the invention illustrated in FIGS. 3 and 4. The bell crank arm 116 is pivotally supported upon a pivot shaft 118 which extends transversely across the stack 90 just above the smoke ledge 42. The bell crank lever 116 thus has one leg which is accessible through the opening at the forward side of the fireplace system for manual manipulation to control the damper 110.

In FIG. 5, a modified embodiment of the invention which includes a slightly different damper plate arrangement is illustrated. Here, the damper plate 110 and actuating shaft 114 are identical to the corresponding elements shown in the embodiment of the invention illustrated in FIGS. 3 and 4. The actuating shaft 114 is pivotally connected at its lower end, however, to a control shaft 120 which extends laterally in front of the smoke shelf 42, and is rigidly secured to a rotatable control rod 124. The rotatable control rod is rotatably mounted through horizontally aligned apertures formed in the two parallel, vertically extending flanges forming portions of the angled lintel plate 76. At the forward side of the control rod 124, a laterally extending handle 126 is provided in an accessible position at the forward side of the fireplace and over the doors 72 and 74 so that the control rod 124 can be rotated by the handle 126. Rotation of the control rod 124 by means of the handle 126 will cause the control shaft 120 to undergo rotation and, by reason of its pivotal connection to the actuating shaft 114, will cause the actuating shaft to move upwardly, thus closing the damper plate 110 at the upper end thereof.

In another alternate form of the invention, illustrated in FIG. 6 of the drawings, the upper portion of the stack 90 is connected to a relatively large heat accumulator box, designated generally by reference numeral 220. The heat accumulator box 220 can be cylindrical, or can be formed as a right parallelepiped. It includes an apertured top wall 222 having a central opening 223 which communicates with a flue pipe 224. Mounted in the stack 90 just below the heat accumulator box 220, a suitable spider 226 is located and includes a hub 228 through which a damper actuating shaft 230 is slidably extended. The damper actuating shaft 230 extends downwardly within the stack in a manner generally similar to the shaft 114 previously described, and carries at its upper end a damper plate 232 which is dimensioned to extend across, and close, the opening 223 in the upper side of the heat accumulator box 220.

For the purpose of very greatly reducing the hazard of fire during the operation of the fireplace system, an outer wall series, or a surrounding encasement, which extends around and encloses the outermost walls of the air plenum chamber, is provided. Thus, as shown in FIGS. 2, 3 and 5, a pair of opposed, substantially parallel side walls 240 and 242 are spaced horizontally slightly from, and extend substantially parallel to, the respective side walls 46 and 48, to define therewith, in association with relatively short front walls 244 and 246, an enclosed space. Extending across the back side of the air plenum chamber in a position substantially parallel to the back wall 44, and interconnecting side walls 240 and 242, is a rear wall 248. A top wall 250 extends substantially parallel to the top wall 108 and projects between the side walls 240 and 242, the back wall 248 and a forward wall 252.

From the illustrated relationship of the walls in the air plenum chamber and the outer walls which surround this chamber and are spaced slightly therefrom, it will be perceived that a relatively narrow space is provided between the outer wall of the air plenum chamber and the surrounding walls. Cooling air is circulated through this space to assure that heat transfer from the air plenum chamber outwardly to the surrounding structure is minimized. In order to permit air to circulate within this cooling space, openings 256 are provided in the lower portions of the walls 44, 46 and 48 of the air plenum chamber, and also in the upper portions of these walls. Air may thus pass from the interior of the air plenum chamber into the space between the external walls thereof and the surrounding outer walls, and in doing so, maintain the temperature of the outer walls adjacent the structural portions of the edifice in which the fireplace is mounted in a relatively cool condition. The manner in which this is accomplished will be explained in greater detail hereinafter.

For the purpose of permitting air to enter the air plenum chamber from the room in which the fireplace system is located, a pair of ducts 260 and 262 extend through the walls 240 and 242, respectively, and walls 46 and 48, respectively, and are extendible to return air grilles (not shown) in the walls of the room. Heated air is removed from the top of the air plenum chamber and conveyed to the ducting of the central heating system by means of ducts 264 and 266.

OPERATION OF THE INVENTION

In utilizing the fireplace system of the invention, a fire is built in a conventional fashion within the firebox 60. It may be the choice of the installer of the system to install removable doors 72 and 74, or not to use such doors. Installation of the doors can be quickly and easily completed in the course of installation of the system by simply attaching the upper and lower door tracks 64–70 to the outer opposed parallel side walls 140 and 142 in the manner best illustrated in FIGS. 2, 3 and 5. It will be assumed in the following discussion that the doors 72 and 74 are installed, and can be used for closing the opening in the firebox 60 at the front side of the system.

As the fire is initiated within the firebox, combustion air is brought via the duct 23 into the hollow base pan 10, and from this location the combustion air moves upwardly into the shroud which defines the combustion air chamber of inverted U-shaped configuration. As the air moves upwardly in the tubular legs 26 and 28 of the shroud 24, it is able to pass through the combustion air openings 34 formed in the inner side wall 32 of each of the tubular legs 26 and 28, and to supply the combustion air needed to sustain the fire. The air is deflected rearwardly toward the location of the logs in the firebox by means of the louvers 36. Further and more precise control of the flow of combustion air can be obtained by fully or partially closing the doors 72 and 74 across the opening at the front side of the firebox. Also, as will be hereinafter explained, the rate of combustion and the heat generated by the fuel burning within the firebox can be controlled by operation of the damper subassembly provided within the system.

As the fire continues within the firebox 60, the hot gases of combustion pass upwardly past the smoke shelf 42 and into the stack 90. As a result of the disposition of the air plenum chamber around the firebox 60 and stack 90, the air within this chamber is highly heated. Air is permitted to enter the air plenum space 56 within the air plenum chamber through air return grilles which can be disposed at any suitable location for introducing into this air plenum space, the air circulated within the edifice where the fireplace system is located. At the top of the air plenum chamber, and communicating with the air plenum space 56, one or more ducts carry the heated air from this location into the ducting of the central heating system conventionally provided in the edifice.

As the fire is burning within the firebox 60, when it is desired to close the doors 72 and 74, they are pulled outwardly from their storage position by means of handles 73 and 75, and are pivoted upon the retention pins 82 so as to permit them to swing around and against the V-shaped guide flanges 76 and 80.

When it is desired to obtain the maximum efficiency in heating the air circulated through the air plenum chamber, and more specifically within the air plenum space 56, the damper subassembly of the fireplace system is utilized. In the type of damper subassembly illustrated in FIGS. 1–3, the bell crank arm 116 is pivoted so as to force the actuating shaft 114 upwardly. This causes the damper plate 110 to pivot on the pivot rod 112 toward the closed position illustrated in dashed lines in FIG. 4. Preferably, the damper plate 110 is only completely closed at such time as there are nothing but hot coals remaining in the firebox, and no smoke is being evolved from burning wood. Prior to this, however, the damper plate 110 can be closed a major portion of the way to its full closure position to retard the velocity at which the products of combustion and hot gases move upwardly through the stack 90, and through the flue which is connected to the upper end thereof, enroute to the atmosphere. In slowing down the velocity of movement of gases upwardly through the stack 90, a relatively greater amount of time is permitted for the hot gases to undergo heat exchange with the air in the surrounding air plenum chamber. Thus, this air can be heated to a relatively high degree, and by providing the proper circulating fan within the ducting by which such heated air is conveyed to the several rooms of the edifice, a large house can be adequately heated even on a cold day.

It may be here pointed out that as an alternative to the damper subassembly shown in FIGS. 1–4, a subassembly of the type shown in FIG. 5 can be utilized. Here, control of the damper plate 110 is effected by turning the control handle 126 to rotate the control rod 124, and to thereby actuate the shaft 114 through the control arm 120.

A special advantage in terms of heat exchange is realized through the use of the damper system shown in FIG. 6 of the drawings. Here, through the use of the heat accumulator box 220, a large surface area for heat exchange is provided which permits the air in the air plenum chamber to be more highly heated at a location immediately prior to the point where it passes into the conveying duct system.

An important feature of the present invention is the provision of means which assures that the outer walls and surfaces of the fireplace system will remain relatively cool, and thus not constitute a fire hazard. Such safety against the possible development of a conflagration is afforded by the cooling effect of air which is circulated within the relatively small space provided between the outer walls of the air plenum chamber (walls 46, 48, 50 and 52), and the surrounding outside walls of the system constituted by walls 240–250. It will be noted that the provision of the openings 256 near the lower end of the walls 44–48 of the air plenum chamber enables the relatively cool air which has just entered the air plenum space 56 from the room in which the fireplace assembly is located to be drawn into the space between the outer walls of the air plenum chamber and the surrounding outside walls of the system. This relatively cool air is then moved upwardly at a relatively higher velocity than the air within the air space 56 will be moved, and is returned to the air space 56 through the holes or openings 256 provided near the upper edges of the walls 44-48 of the air plenum chamber. By reason of this moving curtain of relatively cool air which surrounds the air plenum chamber, there is no risk of excessive heat transfer by conduction through the walls of the air plenum chamber to the surrounding combustible structural elements, thereby constituting a fire hazard.

Although certain preferred embodiments of the present invention have been herein described in order to enable the basic principles of the invention to be comprehensible by those skilled in the art, it will be understood that various changes and innovations within the structure depicted can be effected without departure from these basic principles. Changes and modifications of this type are therefore deemed to be circumscribed by the spirit and scope of the invention, except as the same may be necessarily limited by the appended claims or reasonable equivalents thereof.

What is claimed is:

1. A fireplace system comprising:

a hollow base pan;

means for introducing combustion air to the base pan;

an air plenum chamber over the base pan and including:

a firewall defining a firebox with the base pan; and a wall spaced from the firewall and defining with the firewall a portion of an air plenum space;

a shroud supported upon the base pan and defining a combustion air chamber of inverted U-shaped configuration communicating with the interior of the base pan for receiving the combustion air introduced into said base pan, said shroud including a pair of opposed legs extending vertically from the base pan on opposite sides of a fireplace opening;

outlet means in said legs for directing air into said firebox;

a stack extending upwardly from said firebox and surrounded by said air plenum space;

wall means spaced from said wall of said air plenum and defining a moving air insulation zone around said air plenum chamber; said wall of said air plenum having an opening at its upper and lower portion for moving air to and from said air insulation zone; and a damper means including a damper plate at an elevated location is said stack at a vertical level substantially even with the top of said air plenum chamber.

2. A fireplace system as defined in claim 1;

wherein said air outlet means includes means for removing heated air from the top of said air plenum chamber; further characterized as including:

a heat accumulator box disposed in said stack immediately adjacent said removing means so that the air removed from said air plenum chamber by said removing means is more highly heated at the location of said heat accumulator box immediately prior to the point where it passes into said removing means, said heat accumulator box having an opening in an upper side thereof; and means for moving said damper plate into a position of closure over said opening.

3. A fireplace system as defined in claim 1 and further characterized as including a pair of doors movably mounted over said base pan for movement from a position of closure in which said doors extend across said fireplace opening in which said doors occupy intersecting planes, to a stored position in which said doors extend substantially parallel to each other at locations on opposite sides of said air insulation zone.

4. A fireplace system as defined in claim 1 further characterized as including rearwardly facing, air directing louvers adjacent said outlet means in said legs for deflecting the air from said fireplace opening into the interior of said firebox.

5. A fireplace system as defined in claim 1 and further characterized as including:

a pivot rod pivotally connected to one side of said damper plate and pivotally mounting said damper plate in said stack;

an actuating shaft having an upper end connected to a central position of said damper plate; and a bell crank arm pivotally connected to the lower end of said actuating rod.

6. A fireplace system as defined in claim 1 wherein said means defining a moving air insulation zone around said air plenum chamber comprises an external wall spaced from said air plenum chamber and forming therewith a restricted volume air passageway through which air can be drawn from the lower portion of said air plenum chamber at a relatively high velocity so that heat transfer from the air plenum chamber outward to said external wall is minimized.

7. A fireplace system as defined in claim 6 and further characterized as including:

pairs of door tracks on opposite sides of the fireplace system and attached to said external walls;

a rectangular door slidably mounted in each of said door tracks for storage on opposite sides of the firebox; and means pivotally supporting each door in its respective track pair for pivotation to a position extending across said fireplace opening.

8. A fireplace system as defined in claim 7 and further characterized as including:

a pivot rod pivotally connected to one side of said damper plate and pivotally mounting said damper plate in said stack;

an actuating shaft having an upper end connected to a central portion of said damper plate; and a bell crank arm pivotally connected to the lower end of said actuating rod.

9. A fireplace system as defined in claim 8 further characterized as including louvers adjacent said outlet means in said legs for deflecting the air from said fireplace opening into the interior of said firebox.

10. A fireplace system as defined in claim 7 and further characterized as including:

a heat accumulator box in said stack and having an opening in an upper side thereof; and means for moving said damper plate into a position of closure over said opening.

11. A modular fireplace system comprising:

a hollow base pan having a forward base wall, a pair of side base walls, a back base wall, a top base wall, and a bottom base wall connected to form a substantially right parallelpiped configuration;

means for introducing combustion air to the base pan;

a shroud supported upon said base pan and defining a combustion air chamber of inverted U-shaped configuration communicating with the interior of said base pan, said shroud including a pair of opposed legs extending vertically from said base pan on opposite sides of a fireplace opening and further including a horizontally extending web member interconnecting the opposed legs;

an air plenum chamber positioned over said base pan and including:

a firewall defining a firebox with said base pan;

a back plenum wall disposed in spaced relation, and substantially parallel to, the back surface of said firewall;

a pair of side plenum walls extending forward from respective ends of said back plenum wall; and a pair of front plenum walls, each extending inwardly toward said firewall from the end of a respective one of said side plenum walls opposite said back plenum wall and abutting a respective one of said rear walls of the legs of said shroud;

outlet means in said legs for directing air into said firebox;

a lintel plate disposed adjacent the web member of said shroud;

a stack extending upwardly from said firebox and surrounded by said air plenum chamber;

wall means spaced from said walls of said air plenum and defining a moving air insulation zone around said air plenum chamber; said walls of said air plenum having an opening at its upper and lower portion for moving air to and from said air insulation zone; and a damper means including a damper plate at an elevated location in said stack at a vertical level substantially even with the top of said air plenum chamber.

12. A modular fireplace system as recited in claim 11, wherein the legs of said shroud project downwardly through openings formed in the top base wall of said base pan for receiving combustion air from said base pan.

13. A system as recited in claim 12, further characterized as including rearwardly facing, air directing louvers adjacent said outlet means in said legs for deflecting the air from said fireplace opening into the interior of said firebox.

14. An apparatus as recited in claim 11 and further characterized as including:

said air outlet means including means for removing heated air from the top of said air plenum chamber;

a heat accumulator box disposed in said stack immediately adjacent said removing means so that the air removed from said air plenum chamber by said removing means is more highly heated at the location of said heat accumulator box immediately prior to the point where it passes into said removing means, said heat accumulator box having an opening in an upper side thereof; and means for moving said damper plate into a position of closure over said opening.

15. An apparatus as recited in claim 11, and further characterized as including:

a pivot rod pivotally connected to one side of said damper plate and pivotally mounting said damper plate in said stack;

an actuating shaft having an upper end connected to a central portion of said damper plate;

a control shaft pivotally connected to the lower end of said actuating shaft; and a rotatable control rod rigidly secured to said control shaft and rotatably mounted through said lintel plate.

16. An apparatus as recited in claim 11, wherein said wall means for defining a moving air insulation zone surrounds the air plenum chamber and is spaced therefrom to define an intervening insulating zone, said air plenum chamber having a first opening therethrough at the bottom side thereof to communicate the interior of the air plenum chamber with the interior of the insulating zone, and further having second openings therethrough at the top side thereof to communicate the interior of the air plenum chamber with the interior of the insulating zone, whereby air is removed from the lower end of the air plenum chamber into the insulating zone and moved upwardly through the insulating zone and out from the upper end of the insulating zone back into the air plenum chamber so that said wall means has a relatively cool temperature.

* * * * *